US010018961B2

(12) United States Patent
Sakakibara

(10) Patent No.: US 10,018,961 B2
(45) Date of Patent: Jul. 10, 2018

(54) IMAGE FORMING APPARATUS HAVING A ROTATABLE DEVELOPMENT CARRYING MEMBER DISPOSED IN A PARTICULAR RELATION TO A DEVELOPER SUPPLY ROLLER

(71) Applicant: CANON KABUSHIKI KAISHA, Tokyo (JP)

(72) Inventor: Yuichi Sakakibara, Fuchu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/381,200

(22) Filed: Dec. 16, 2016

(65) Prior Publication Data

US 2017/0176925 A1 Jun. 22, 2017

(30) Foreign Application Priority Data

Dec. 18, 2015 (JP) ..... 2015-247212

(51) Int. Cl.

*G03G 21/00* (2006.01)
*G03G 21/16* (2006.01)
*G03G 21/18* (2006.01)

(52) U.S. Cl.

CPC ..... *G03G 21/1676* (2013.01); *G03G 21/1609* (2013.01); *G03G 21/1821* (2013.01); *G03G 21/1853* (2013.01); *G03G 2221/163* (2013.01); *G03G 2221/1684* (2013.01); *G03G 2221/1869* (2013.01)

(58) Field of Classification Search

CPC ..... G03G 15/0189; G03G 21/1676; G03G 21/1821; G03G 21/1853; G03G 2215/0119; G03G 2215/0122; G03G 2215/0125; G03G 2221/163; G03G 2221/1869

USPC ..... 399/112, 119

See application file for complete search history.

(56) References Cited

U.S. PATENT DOCUMENTS 8,452,208 B2 5/2013 Kikuchi
8,761,633 B2 6/2014 Souda
8,892,000 B2 * 11/2014 Souda ..... G03G 21/1623 399/110

(Continued)

FOREIGN PATENT DOCUMENTS

JP 2003076106 A 3/2003
JP 2010102304 A 5/2010

(Continued)

*Primary Examiner* — Robert Beatty
(74) *Attorney, Agent, or Firm* — Rossi, Kimms & McDowell LLP

(57) ABSTRACT

An image forming apparatus includes a main assembly; a rotatable photosensitive member; and a cartridge detachably mounted in the main assembly, the cartridge including a rotatable developer carrying sleeve for carrying a developer to be supplied to the photosensitive member and a developer accommodating portion for accommodating the developer to be supplied to the sleeve, wherein with respect to a mounting direction of the cartridge, the developer accommodating portion is disposed downstream of a rotation axis of the sleeve, and a developing portion where a surface of the sleeve is in contact with or closest to the photosensitive member is disposed downstream of the rotation axis of the sleeve or at the same position as the rotation axis of the sleeve.

18 Claims, 13 Drawing Sheets

(56) References Cited

U.S. PATENT DOCUMENTS

| | | | | |
|---|---|---|---|---|
| 9,201,357 | B2 * | 12/2015 | Sato | G03G 15/234 |
| 2003/0091366 | A1 * | 5/2003 | Saito | G03G 21/0011 399/111 |
| 2009/0142092 | A1 * | 6/2009 | Sato | G03G 21/1846 399/111 |
| 2013/0223878 | A1 * | 8/2013 | Sato | G03G 21/1821 399/119 |

FOREIGN PATENT DOCUMENTS

| | | | |
|---|---|---|---|
| JP | 2010282234 | A | 12/2010 |
| JP | 2012194395 | A | 10/2012 |

* cited by examiner

IMAGE FORMING APPARATUS HAVING A ROTATABLE DEVELOPMENT CARRYING MEMBER DISPOSED IN A PARTICULAR RELATION TO A DEVELOPER SUPPLY ROLLER

FIELD OF THE INVENTION AND RELATED ART

The present invention relates to an image forming apparatus such as a laser printer and a facsimileing machine, which employs an electrophotographic image formation process. It relates to also a cartridge which is removably installable in the image forming apparatus.

Some image forming apparatuses which employ an electrophotographic image formation process are structured so that a photosensitive member unit having a photosensitive member etc., and a development cartridge having a development roller, etc., are removably installable in the main assembly of the apparatus.

An image forming apparatus consumes toner (as developer) each time it forms an image. Thus, as the toner in the development cartridge in the main assembly of the apparatus is consumed so much that it becomes impossible for the apparatus to form an image, the development cartridge reaches the end of its life span, and therefore, it has to be replaced.

There have been proposed various structural designs for a combination of an image forming apparatus and a cartridge therefor, in order to make it easier to install a cartridge into the main assembly of the apparatus, or uninstall the cartridge from the main assembly. For example, the image forming apparatus disclosed in Japanese Laid-open Patent Application No. 2012-194395 is structured so that its photosensitive drum is placed in a position in which it opposes the development roller or a position in which the photosensitive drum remains separated from the development roller, and also, that during the installation or uninstallation of the development cartridge, the photosensitive drum is kept in the position in which it is kept separated from the development roller.

However, an image forming apparatus structured like the one disclosed in Japanese Laid-open Patent Application No. 2012-194395 requires a space for allowing the photosensitive drum to be moved between the position in which it opposes the development roller and the position in which it remains separated from the development roller, making it necessary for the image forming apparatus, in which the development cartridge is installed, to be increased in size. Further, in the case of the image forming apparatus structured as disclosed in Japanese Laid-open Patent Application No. 2012-194395, it had to be devised in structure to ensure that during the installation or uninstallation of the development cartridge, the photosensitive drum is positioned in a manner in which it remains separated from the development roller.

SUMMARY OF THE INVENTION

The present invention is for solving at least one of the above described issues. Thus, the primary object of the present invention is to provide a cartridge which can contribute to the effort to reduce an image forming apparatus in size, or a cartridge which can be installed into, or uninstalled from, the main assembly of an image forming apparatus even if the development roller and photosensitive member remain unseparated from each other.

According to an aspect of the present invention, there is provided an image forming apparatus for forming an image on an image formation medium, said image forming apparatus comprising a main assembly; a rotatable photosensitive member; and a cartridge detachably mounted in said main assembly, said cartridge including a rotatable developer carrying member configured to carry a developer to be supplied to said photosensitive member and a developer accommodating portion configured to accommodate the developer to be supplied to said developer carrying member, wherein with respect to a mounting direction of said cartridge, said developer accommodating portion is disposed downstream of a rotation axis of said developer carrying member, and a developing portion where a surface of said developer carrying member is in contact with or closest to said photosensitive member is disposed downstream of the rotation axis of said developer carrying member or at the same position as the rotation axis of said developer carrying member.

Further features of the present invention will become apparent from the following description of exemplary embodiments with reference to the attached drawings.

DESCRIPTION OF THE EMBODIMENTS

Embodiment 1

Hereinafter, the present invention is described with reference to a couple of preferred embodiments of the present invention. By the way, the measurements, materials, shapes of the components of the image forming apparatus, and the positional relationship among the components, etc., are not intended to limit the present invention in scope.

<Image Forming Apparatus>

First, the overall structure of the image forming apparatus A in this embodiment of the present invention, and the image forming operation of the apparatus A, are described with reference to appended drawings.

The image forming apparatus A is an electrophotographic color image forming apparatus for forming a toner image on a sheet of recording medium, with the use of four color toners (developers) which are different in color, more specifically, yellow y, magenta m, cyan c, and black k toners (developers). By the way, in this embodiment, a sheet of recording paper is used as an image formation medium. However, a sheet of cloth, OHP film, etc., can be used as the recording medium for the apparatus.

Figure 1:
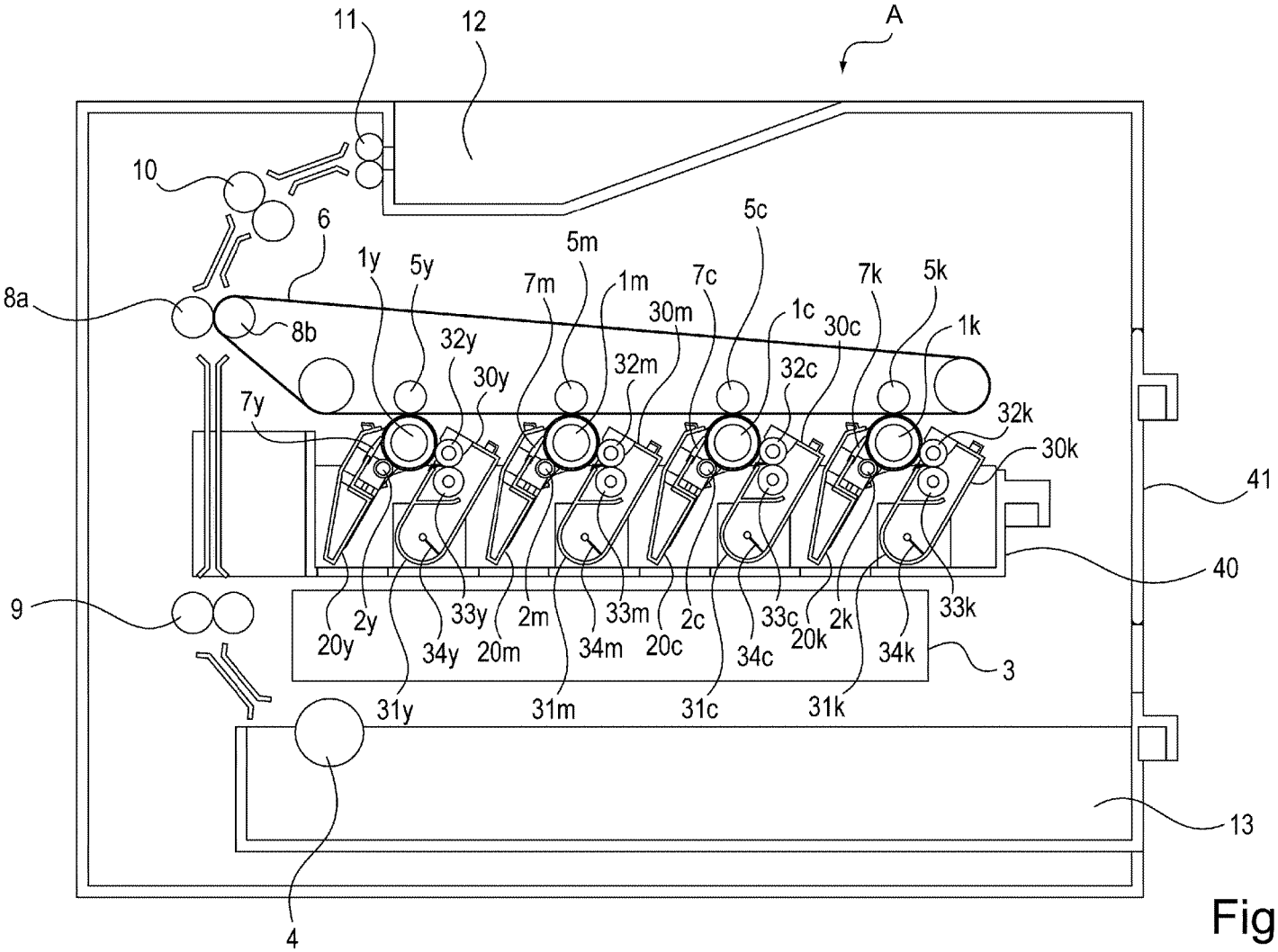
FIG. 1 is a sectional view of the image forming apparatus in the first embodiment of the present invention. It shows the general structure of the apparatus.

Referring to FIG. 1, the image forming apparatus A has: an image forming portion; a sheet feeding portion for supplying the image forming portion with a sheet of recording medium; and a fixing portion for fixing a toner image to the sheet.

The image forming portion employs: four photosensitive member units 20 (20*y*, 20*m*, 20*c* and 20*k*) which correspond to yellow, magenta, cyan and black colors, respectively; and four development cartridges 30 (30*y*, 30*m*, 30*c* and 30*k*) which also correspond to yellow, magenta, cyan, and black colors, respectively. Further, it is equipped with an intermediary transfer unit, and a laser scanner nit 3.

Figure 2:
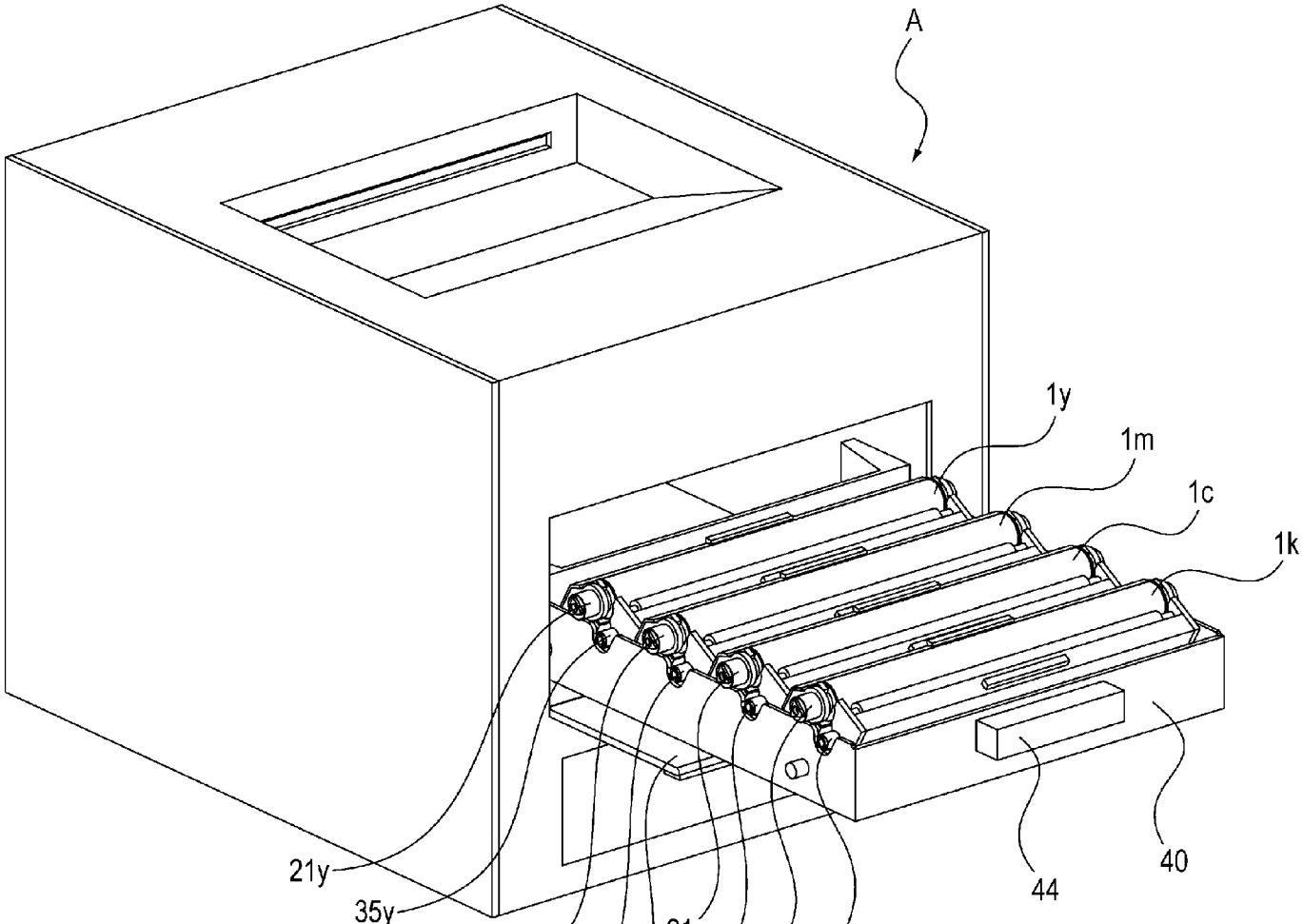
FIG. 2 is a perspective view of the image forming apparatus shown in FIG. 1, when the cartridge drawer of the apparatus is in its outermost position.

Each photosensitive member unit 20 has photosensitive drums 1 (1*y*, 1*m*, 1*c* or 1*k*) as image bearing members. Each photosensitive drum 1 is made up of a piece of aluminum cylinder, for example, and a layer of organic photoconductive substance coated on the peripheral surface of the aluminum cylinder. It is rotatably supported by a pair of unshown supporting members, by its lengthwise end portions. One of the supporting members is provided with a drum coupling member 21 (21*y*, 21*m*, 21*c* or 21*k*) for receiving driving force from an unshown driving force source, such as a motor (FIG. 2). Thus, the driving force from the driving force source is transmitted to the photosensitive drum 1 through the drum coupling member 21, whereby the photosensitive drum 1 is rotated counterclockwise in FIG. 1.

Further, the photosensitive member unit 20 has: a charge roller 2 (2*y*, 2*m*, 2*c* or 2*k*) for charging the photosensitive drum 1; and a cleaning member 7 (7*y*, 7*m*, 7*c* or 7*k*) for removing the toner particles remaining adhered to the peripheral surface of the photosensitive drum 1. The charge roller 2 is of the so-called contact type. That is, it charges the photosensitive drum 1 by being placed in contact with the photosensitive drum 1. It is an electrically conductive roller.

The development cartridge 30 has: a toner container 31 (31*y*, 31*m*, 31*c* or 31*k*) as a toner storing portion 31*a* (developer storing portion) in which yellow, magenta, cyan or black toner is stored. Further, it has a development roller 32 (32*y*, 32*m*, 32*c* or 32*k*) as a developer bearing member which bears the toner to be supplied to the photosensitive drum 1. The development roller 32 is rotatably supported. Further, the development cartridge 30 has a supply roller 33 (33*y*, 33*m*, 33*c* or 33*k*) for supplying the development roller 32 with toner. Moreover, the development cartridge 30 has a stirring-conveying member 34 (34*y*, 34*m*, 34*c* or 34*k*) which delivers toner in the toner storing portion 31*a* to the supply roller 33 while stirring the toner. By the way, one end of the development cartridge 30, in terms of the direction parallel to its rotational axis of the development roller 32, has a development roller coupling member 35 (FIG. 2), enabling the development roller 32 to receive the driving force from the unshown driving force source.

The image forming apparatus A is structured so that the above described photosensitive member unit 20 and development cartridge 30 can be independently installed into, or uninstalled from, the main assembly of the apparatus A. That is, as the toner in the development cartridge 30 is completely consumed, that is, as the development cartridge 30 reaches the end of its life span, the development cartridge 30 can be replaced independently from the photosensitive member unit 20, whereas as the photosensitive drum 1 reaches the end of its life span, it can be replaced independently from the development cartridge 30. By the way, the combination of the photosensitive member unit 20 and development cartridge 30 make up a process cartridge P. What remains after the removal of both the photosensitive member unit 20 and development cartridge 30 is the main assembly of the image forming apparatus A.

The photosensitive member unit 20 and development cartridge 30 are to be installed into the main assembly of the image forming apparatus when the cartridge drawer 40 (movable member) is in its outermost position, as shown in FIG. 2. As the door 41 is closed after the installation of the photosensitive drum units 20 and development cartridges 30 into the cartridge drawer 40, each photosensitive member unit 20 and each development cartridge 30 are placed in their preset positions in the main assembly of the image forming apparatus A. Because the image forming apparatus A is structured as described above, all the photosensitive drum units 20 and all the development cartridges 30 in the cartridge drawer 40 can be pushed into, or pulled out of, the main assembly of the image forming apparatus A together. Thus, the image forming apparatus A in this embodiment is superior to any conventional image forming apparatus structured so that each of its photosensitive member units 20 and each of its development cartridge 30 have to be individually installed into its main assembly, in terms of the efficiency with which the photosensitive drum unit 20 and/or development cartridge 30 are replaceable. By the way, the installation and uninstallation of the photosensitive member unit 20 and development cartridge 30 are described later in detail.

The laser scanner unit 3 is disposed below the combination of the photosensitive member units 20 and development cartridges 30. It forms an electrostatic latent image on the peripheral surface of each photosensitive drum 1 by projecting a beam L of laser light from an unshown laser diode while modulating the beam L with image formation signals.

The intermediary transfer unit has primary transfer rollers 5 (5*y*, 5*m*, 5*c* and 5*k*), an endless (cylindrical) intermediary transfer belt 6 (transfer belt), a secondary transfer roller 8*a*, a belt-backing roller elastic layer 8*b* (which opposes secondary transfer roller with presence of belt 6 between itself and secondary transfer roller), etc.

Next, the image forming operation of the image forming apparatus A is described. First, an image formation start signal is outputted by a controlling portion (unshown). As the signal is outputted, sheets of recording medium stored in layers in a sheet storage 13 begin to be sent one by one to the image forming portion by a pickup roller 4.

Meanwhile, in the image forming portion, the peripheral surface of each photosensitive drum 1 is charged by the charge roller 2. Then, laser scanner unit 3 projects the beam L of laser light from its unshown internal light source upon the peripheral surface of the photosensitive drum 1 while modulating the beam L with the information of the image to be formed. As a result, an electrostatic latent image, which reflects the information of the image to be formed, is effected on the peripheral surface of the photosensitive drum 1. Then, a toner image is formed on the peripheral surface of the photosensitive drum 1 by adhering toner to the electrostatic latent image on the peripheral surface of the photosensitive drum 1 from the development roller 32 by applying development bias to the development roller 32.

The toner image formed on each of the four photosensitive drums 1 is transferred (primary transfer) onto the intermediary transfer belt 6, whereby a full-color toner image is synthetically formed of yellow, magenta, cyan, and black monochromatic images, on the intermediary transfer belt 6.

Next, as the intermediary transfer belt 6 rotates by receiving the driving force from the unshown driving force source, the toner images, which have just been transferred (primary transfer) onto the intermediary transfer belt 6, are made to reach the secondary transferring portion by the rotation of the intermediary transfer belt 6. The secondary transferring portion is formed by the aforementioned secondary transfer roller 8*a* and belt-backing roller 8*b* which are on the downstream side of the image forming portion. Then, a sheet of recording medium is introduced into the secondary transferring portion by a pair of registration rollers 9 with preset control timing. While the sheet is conveyed through the secondary transferring portion, the toner images on the intermediary transfer belt 6 are transferred onto the sheet.

Thereafter, the sheet, onto which the toner images have just been transferred, is introduced into a fixing device 10, and is conveyed through the fixing device 10. While the sheet is conveyed through the fixing device 10, the sheet and the toner images thereon are heated and pressed in the fixation nip of the fixing device 10, whereby the toner particles in the toner images are fixed to the sheet. Thereafter, the sheet is discharged from the fixing device 10, and is discharged as a full-color print into a delivery tray 2 by a pair of discharge rollers 11. This is how a full-color image is formed on a sheet of recording medium by the image forming operation of the image forming apparatus A.

By the way, in this embodiment, the image forming apparatus A is structured to enable the secondary transfer roller 8*a* to be movable by a roller shifting mechanism (unshown) so that during an image forming operation, the secondary transfer roller 8*a* is kept in a contact position in which it is kept in its contact position in which it forms the secondary transferring portion by being placed in contact with the intermediary transfer belt 6, whereas during other operations than the image forming operation, it is kept in a noncontact position in which it is kept separated from the intermediary transfer belt 6. However, this embodiment is not intended to limit the present invention in scope. For example, the present invention is also applicable to an image forming apparatus, the secondary transfer roller 8*a* of which is always kept in contact with the intermediary transfer belt 6.

Also in this embodiment, the image forming apparatus A is structured so that the intermediary transfer belt 6 is disposed above the combination of the four photosensitive drums 1, whereas the laser scanner unit 3 is disposed below the combination of the photosensitive drums 1. Therefore, the toner images on the intermediary transfer belt 6 can be transferred onto a sheet of recording medium by the secondary transfer roller 8*a* as soon as they are transferred onto the intermediary transfer belt 6. Thus, the image forming apparatus A is meritorious in that it takes less time to output the first print than image forming apparatuses which are different in structure from the one in this embodiment.

<Cartridge Drawer>

Figure 3:
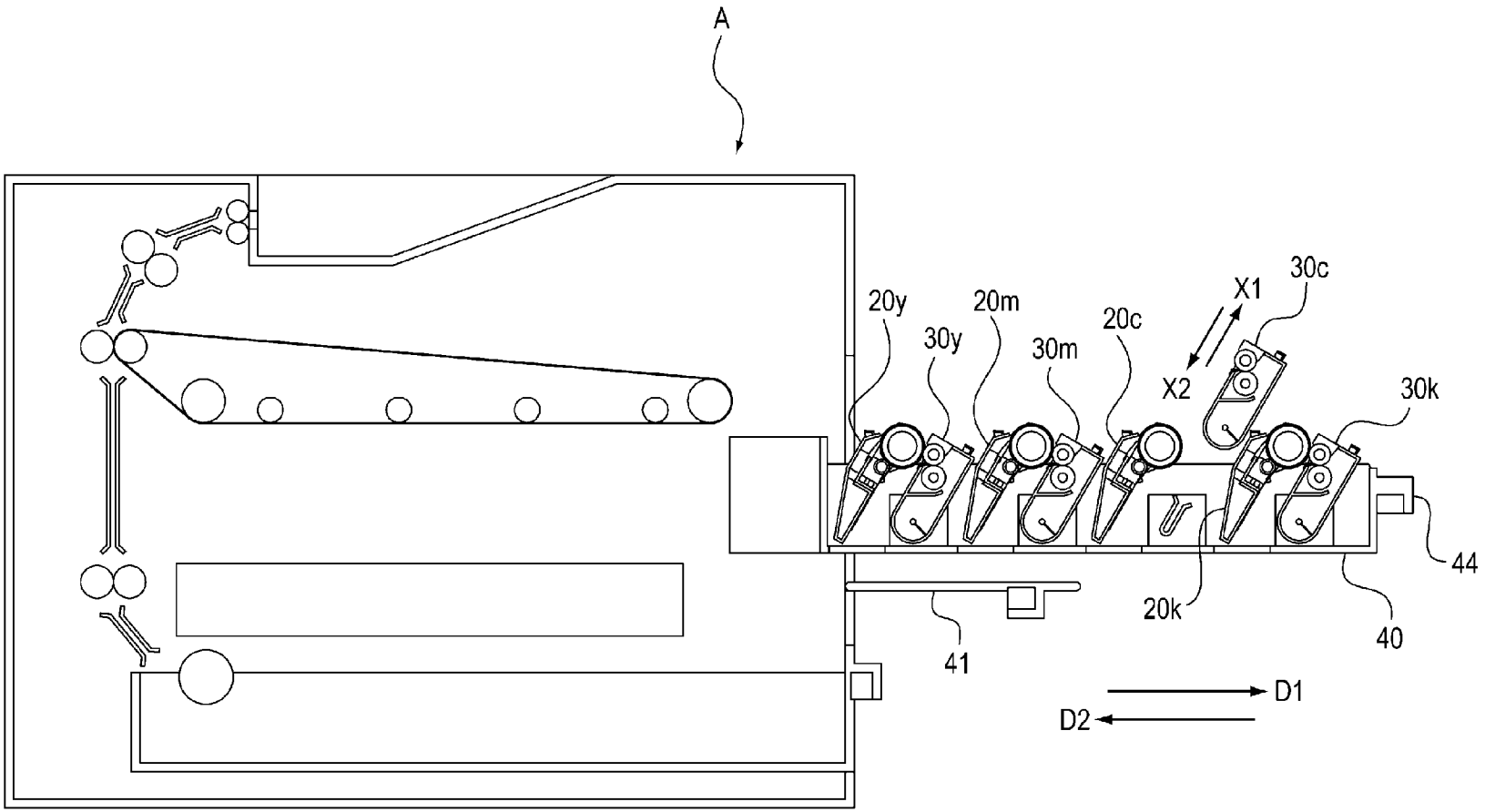
FIG. 3 is a sectional view of the image forming apparatus when the cartridge drawer is in its outermost position.
Figure 4:
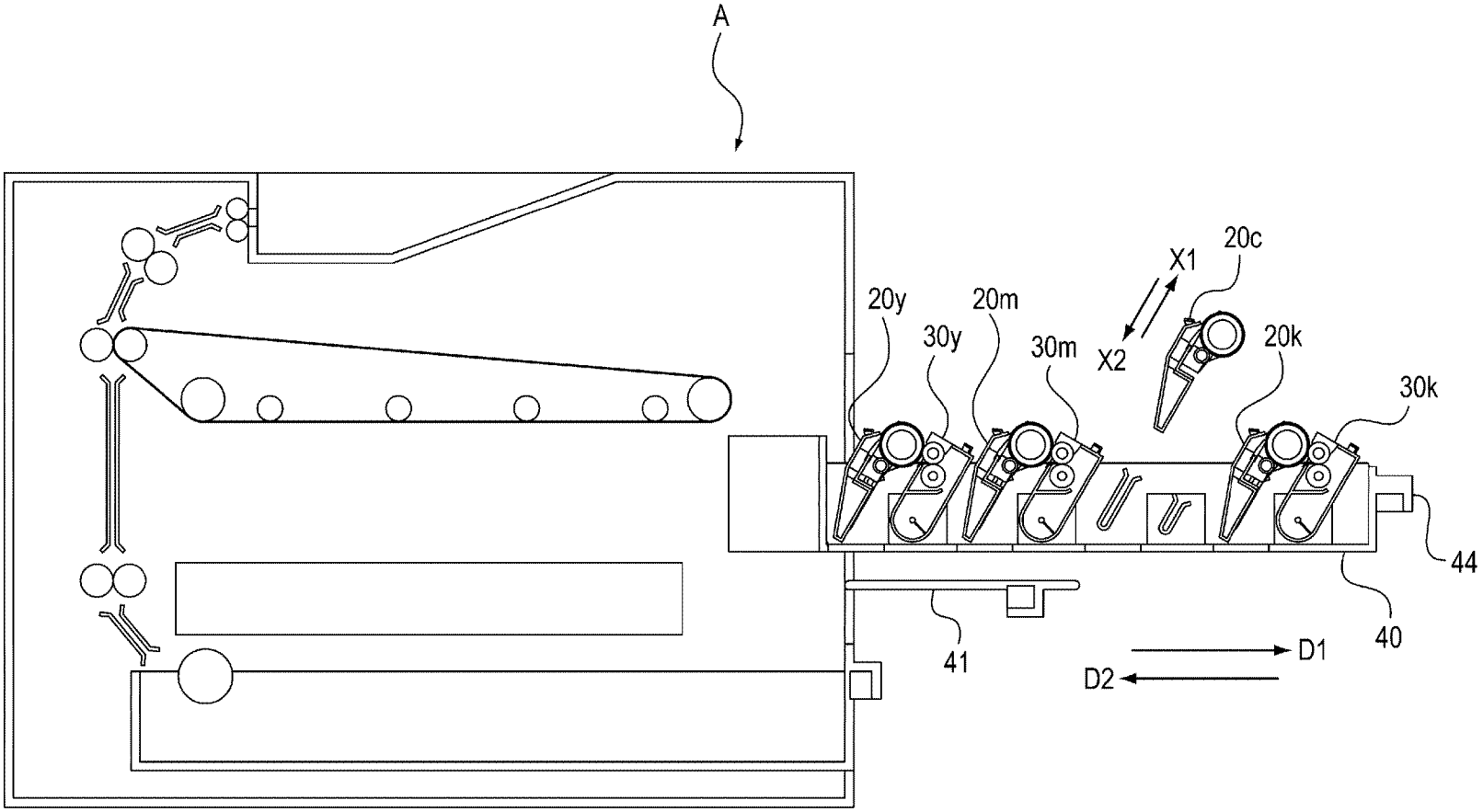
FIG. 4 also is a sectional view of the image forming apparatus when its cartridge drawer is in its outermost position.

Next, the cartridge drawer 40 is described in detail about its structure. Referring to FIGS. 3 and 4, the image forming apparatus A is structured so that the cartridge drawer 40 can be linearly moved (pushed into, or pulled out of, image forming apparatus main assembly in directions indicated by arrow marks D1 and D2, respectively) relative to the main assembly of the image forming apparatus A in practically horizontal direction. That is, the cartridge drawer 40 can be moved between its outermost position, which is outside the main assembly of the image forming apparatus A, and its innermost position which is inside the main assembly of the image forming apparatus A, while supporting the photosensitive member units 20 and development cartridges 30. It is when the cartridge drawer 40 is in the outermost position that any of the photosensitive member units 20 and development cartridges 30 can be installed into, or uninstalled from, the cartridge drawer 40. The cartridge drawer 40 is structured so that as the photosensitive member units 20 are installed into the cartridge drawer 40, the photosensitive drums 1 in the development cartridge 30 are aligned in parallel in the moving direction (horizontal direction) of the cartridge drawer 40, and the axial line of the development roller 32 in each development cartridge 30 becomes perpendicular to the moving direction of the cartridge drawer 40. As the cartridge drawer 40 is moved into the innermost position, the installation of the photosensitive member units 20 and development cartridges 30 into the main assembly of the image forming apparatus A is completed, and therefore, the image forming apparatus A is enabled to carry out the above described image forming operation.

Figure 5:
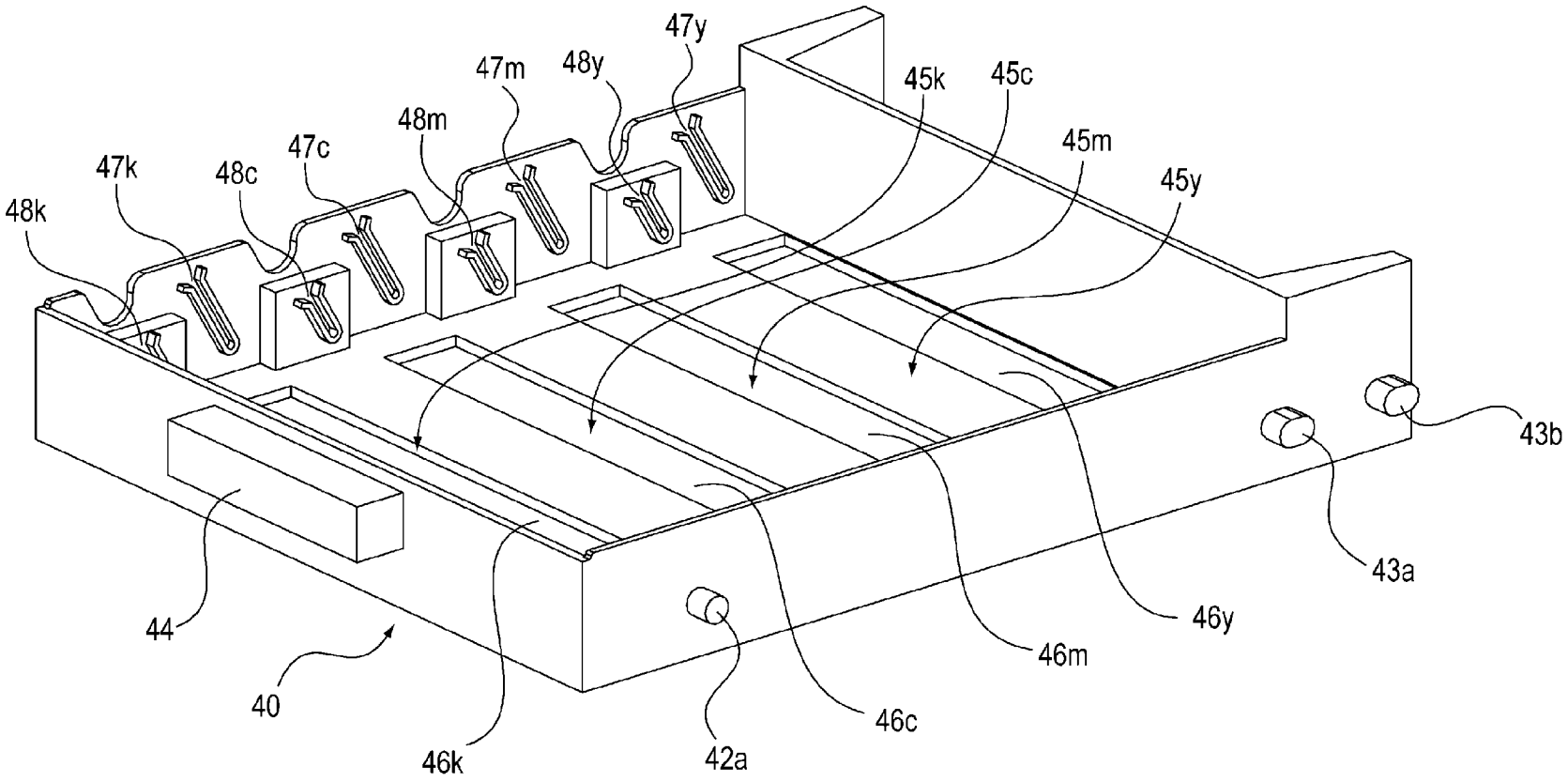
FIG. 5 is a perspective view of the cartridge drawer.
Figure 6:
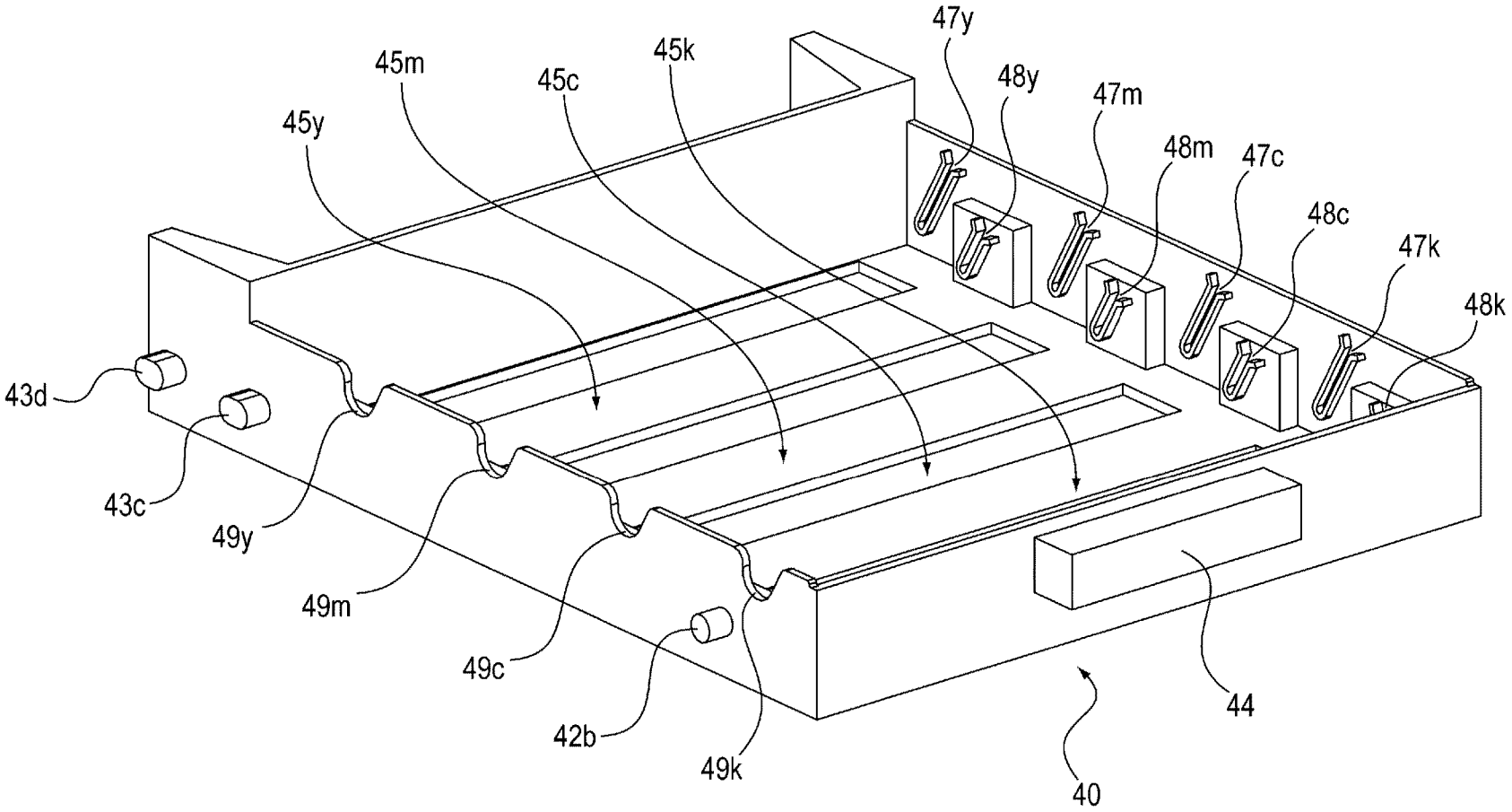
FIG. 6 also is a perspective view of the cartridge drawer.

FIGS. 5 and 6 are perspective views of the cartridge drawer 40. They are different in the angle of view. Referring to FIGS. 5 and 6, the cartridge drawer 40 has a pair of protrusions 42 (42*a* and 42*b*) and four protrusions 43 (43*a*-43*d*) which are guided by unshown guiding portions with which the main assembly of the image forming apparatus A is provided.

Each protrusion 42 is cylindrical, and is outwardly protrusive from the outward surface of one of the lateral walls of the cartridge drawer 40. It is guided so that the cartridge drawer 40 is moved into the preset innermost position for the cartridge drawer 40. Each protrusion 43 is columnar, and is oval in cross-section. It is outwardly protrusive from the outward surface of one of the lateral walls of the cartridge drawer 40. It is structured so that it prevents the cartridge drawer 40 from tilting when the cartridge drawer 40 is pulled out of the main assembly of the image forming apparatus A or in its outermost position.

Further, the downstream end of the cartridge drawer 40, in terms of the direction in which the cartridge drawer 40 is pulled out of the main assembly of the image forming apparatus A, has a handhold portion 44 which is for a user to grasp.

Further, the cartridge drawer 40 is provided with four chambers 45 (45*y*, 45*m*, 45*c* and 45*k*) for accommodating the photosensitive member units 20 and development cartridges 30. The four chambers 45 are aligned in parallel in the cartridge drawer movement direction. Further, the bottom wall of each cartridge chamber 45 is provided with an opening 46 (46*y*, 46*m*, 46*c* and 46*k*). It is through this opening 45 that a beam L of laser light is projected upon the peripheral surface of the photosensitive drum 1 from the laser scanner unit 3.

Each of the lengthwise ends of each chamber 45 is provided with a guide 47 (47*y*, 47*m*, 47*c* or 47*k*) and a guide 48 (48*y*, 48*m*, 48*c* or 48*k*). The guide 47 is for guiding the photosensitive member unit 20 into the preset position in the cartridge drawer 40. The guide 48 is for guiding the developer container 40 into the preset position in the cartridge drawer 40.

Further, one of the lateral walls of the cartridge drawer 40 is provided with recesses 49 (49*y*, 49*m*, 49*c* and 49*k*), into which development roller coupling members 35 move as the door 41 is closed. As the development roller coupling member 35 moves into the corresponding recess 49, the drum coupling member 21 moves toward the recess 49. Consequently, the development roller coupling member 35 and drum coupling member 21 engage with unshown coupling members, one for one, with which the main assembly of the image forming apparatus A is provided.

<Photosensitive Member Unit and Development Cartridge>

Next, the installation of the photosensitive member unit 20 and development cartridge 30 into the cartridge drawer 40 is described.

Figure 7:
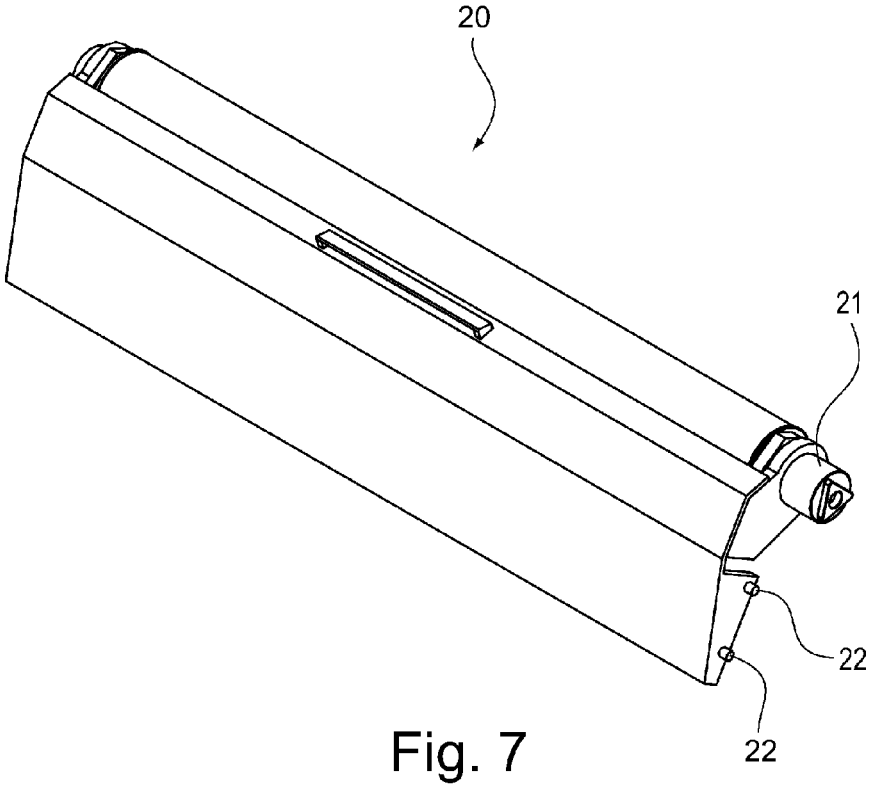
FIG. 7 is a perspective view of the photosensitive member unit.
Figure 8:
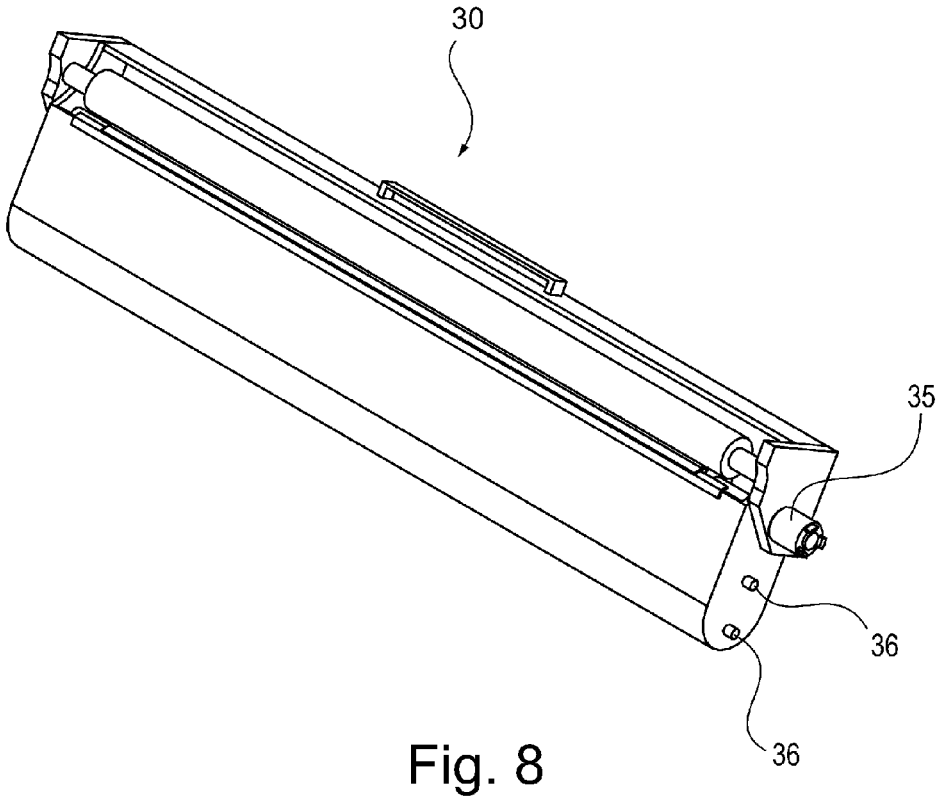
FIG. 8 is a perspective view of the development cartridge.

Referring to FIG. 7, the lengthwise ends of each photosensitive member unit 20 are provided with a protrusion 22. Further, referring to FIG. 8, the lengthwise ends of each development cartridge 30 are provided with a protrusion 36.

The photosensitive member units 20 and development cartridges 30 are installed into the cartridge drawer 40 through the following steps. First, the photosensitive member unit 20 is placed in the cartridge drawer 40 in such a manner that the protrusions 22 of the photosensitive member unit 20 fit into guides 47, one for one, with which the cartridge drawer 40 is provided. Then, the developer container 40 is installed into the cartridge drawer 40 in such a manner that the protrusions 36 of the development cartridge 30 fit into the guides 49, one for one, with which the cartridge drawer 40 is provided. Consequently, the photosensitive member unit 20 and development cartridge 30 are guided into their preset positions in the chamber 45.

When the cartridge drawer 40 is in its innermost position in the main assembly of the image forming apparatus A, the intermediary transfer belt 6 is above the photosensitive drum 1, whereas the laser scanner unit 3 is below the photosensitive drum 1 (FIG. 1).

Figure 9:
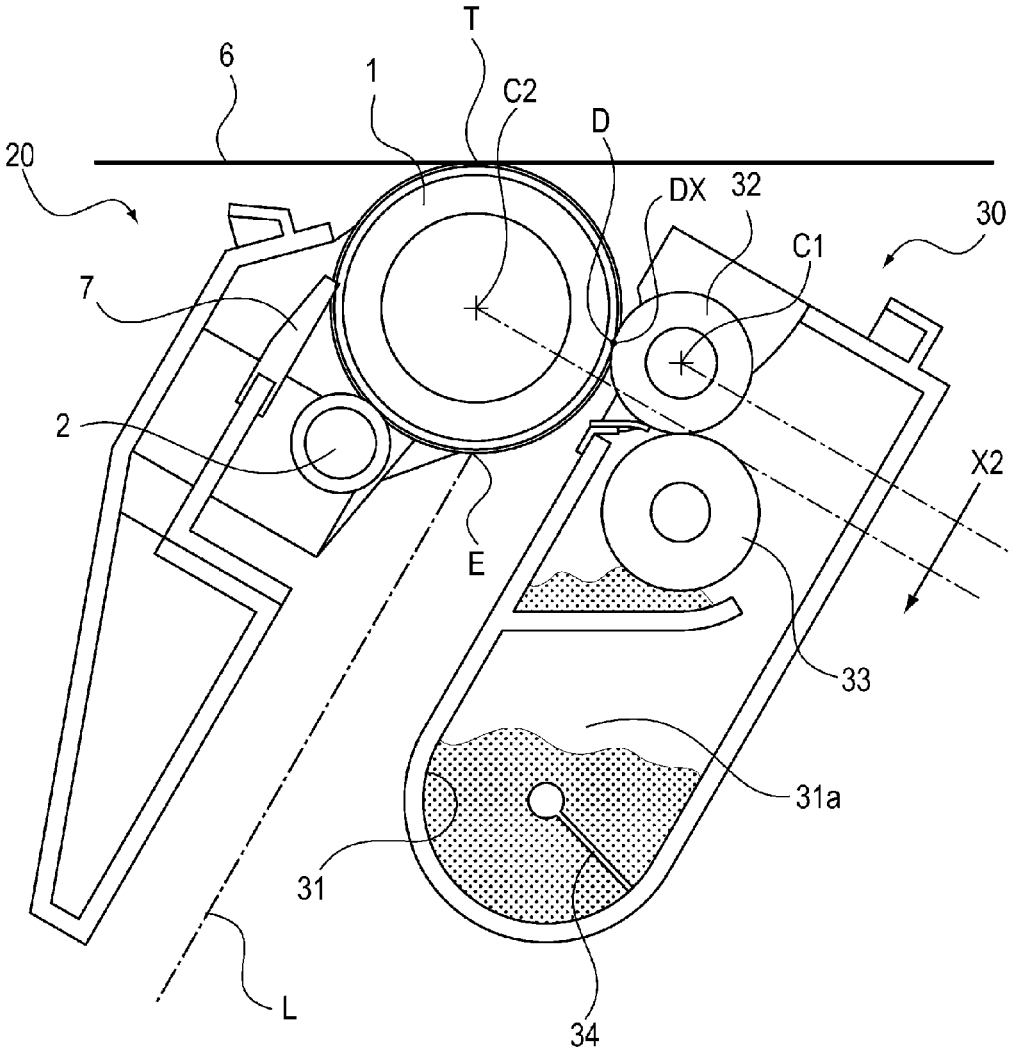
FIG. 9 is a sectional view of a combination of the photosensitive member unit and development cartridge when the unit and cartridge are in their designated image formation position.

Next, referring to FIG. 9, the portion of the peripheral surface of the photosensitive drum 1, which is in the area of contact between the peripheral surface of the photosensitive drum 1 and the intermediary transfer belt 6 is referred to as a transferring portion T, and the portion of the peripheral surface of the photosensitive drum 1, which is in the area in which it is exposed to the beam L of laser light from the laser scanner unit 3 to form a latent image on the peripheral surface of the photosensitive drum 1, is referred to as an exposure portion. Further, the portion of the peripheral surface of the photosensitive drum 1, which is in the area in which the peripheral surface of the photosensitive drum 1 is in contact with, or closest to, the development roller 32, is referred to as a development portion D. Further, the portion of the peripheral surface of the development roller 32, which is in the area in which the peripheral surface of the development roller 32 is in contact with, or closest to, the photosensitive drum 1, is referred to as development portion DX.

The image forming apparatus A is structured so that after the successful installation of the photosensitive member units 20 and development cartridges 30 into the cartridge drawer 40, the transfer portion T is on the upstream side of the development portion D, and the exposure portion E is on the downstream side of the development portion D, in terms of the direction X2 in which the development cartridge 30 is installed into the cartridge drawer 40.

Regarding the development cartridge 30, the image forming apparatus A is structured so that after the installation of the development cartridge 30 into the cartridge drawer 40, the toner storing portion 31*a* is on the downstream side of the rotational axis C1 of the development roller 32, and the development portion DX is on the downstream side of the rotational axis of the development roller 32, in terms of the development cartridge installation direction X2. Further, the image forming apparatus A is structured so that after the installation of the photosensitive drum 1 and development cartridge 30 into the cartridge drawer 40, the development cartridge 30 is in such a space that is on the downstream side of the intermediary transfer belt 6, in terms of the development cartridge insertion direction X2.

Further, the image forming apparatus A is structured so that after the installation of the development cartridge 30 into the cartridge drawer 40, the rotational axis C1 of the development roller 32 coincides with, or is on the upstream side of, the rotational axis C2 of the photosensitive drum 1, in terms of the development cartridge installation direction X2.

Since the image forming apparatus A is structured as described above, the photosensitive member unit 20 does not intrude into the area through which the development cartridge 30 is installed into the cartridge drawer 40. Therefore, the development cartridge 30, which is higher than the photosensitive member unit 20 in the frequency with which they have to be replaced, can be installed into, or uninstalled from, the cartridge drawer 40 without moving the photosensitive drum 1. That is, this embodiment of the present invention can contribute to the size reduction of the image forming apparatus A in which the development cartridge 30 is installed.

Further, this embodiment makes it unnecessary to provide an image forming apparatus with a mechanism for changing the photosensitive drum 1 in position, contributing therefore to the effort to reduce the image forming apparatus in component count, simplify the apparatus in structure, improve an image forming apparatus in assembly efficiency, and reduce an image forming apparatus in manufacturing cost.

Figure 10:
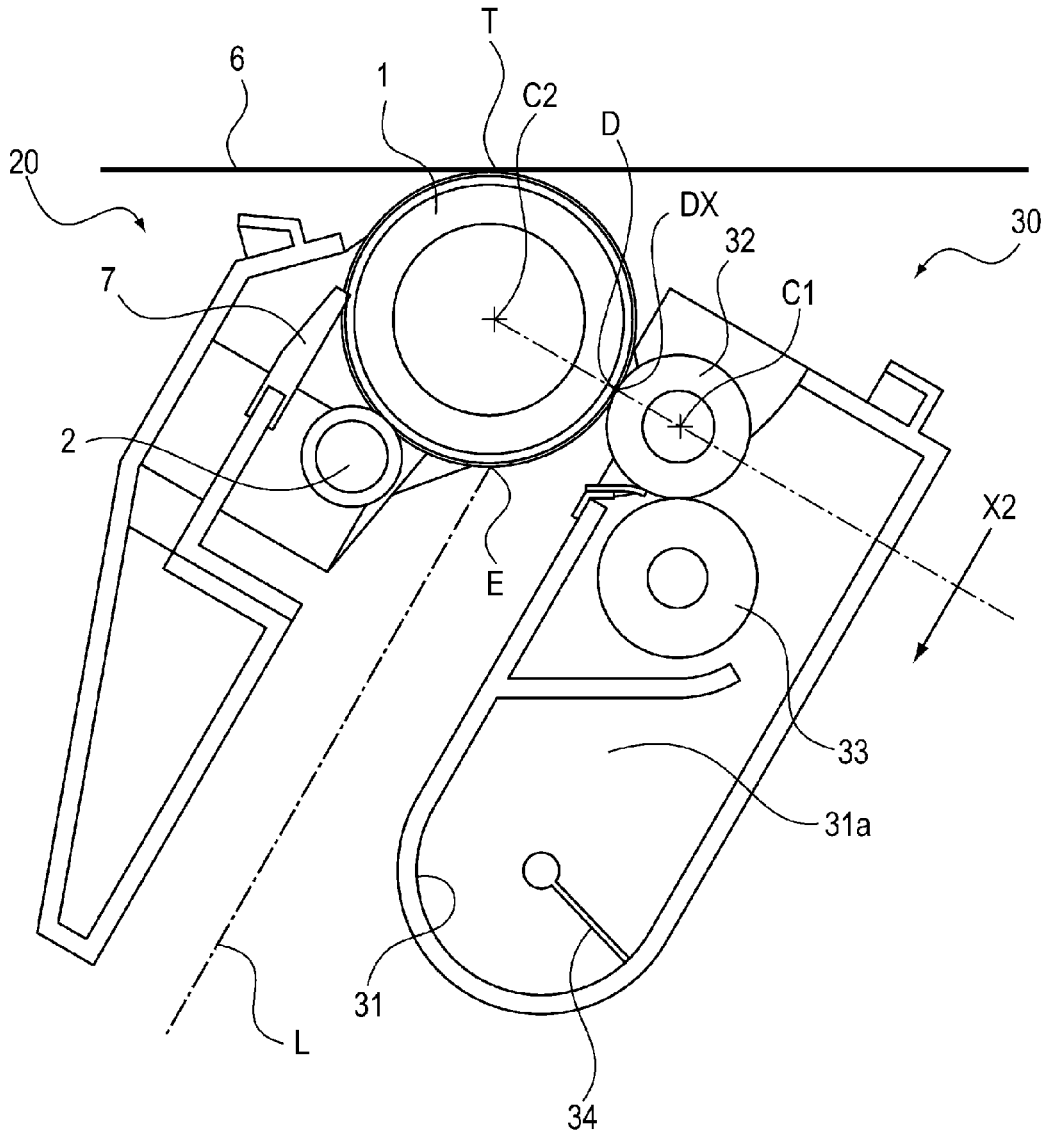
FIG. 10 is a sectional view of a combination of the photosensitive member unit and development cartridge, which is different from the one shown in FIG. 9, when the unit and cartridge are in their designated image formation position.

By the way, referring to FIG. 10, effects similar to those described above can be achieved by structuring the image forming apparatus A so that after the installation of the development cartridge 30, the rotational axis C1 of the development roller 32 coincides with the rotational axis C2 of the photosensitive drum 1 in terms of the development cartridge installation direction X2.

In the case where the image forming apparatus A is structured as shown in FIG. 10, the developing portion D coincides with the rotational axis of the development roller 32 in terms of the development cartridge installation direction X2.

Further, in the first embodiment described above, the image forming apparatus A was such an image forming apparatus that employs the intermediary transfer belt 6 as a transfer belt. However, the first embodiment is not intended to limit the present invention in scope. That is, the present invention is also applicable to an image forming apparatus which employs an electrostatic conveyance belt, in place of the transfer belt, for conveying a sheet of recording medium. In such a case, a toner image (multicolor toner image) is formed on a sheet of recording medium by sequentially transferring the monochromatic toner images from the photosensitive drums 1 (1*y*, 1*m*, 1*c* and 1*k*), in the transfer nip formed between the primary transfer roller 5 (5*y*, 5*m*, 5*c* and 5*k*) and electrostatic conveyance belt.

Further, the image forming apparatus A in the above described embodiment employed the laser scanner 3 as an exposing means. However, the first embodiment is not intended to limit the present invention in scope. For example, the present invention is also applicable to an image forming apparatus which employs a solid state exposure unit which has multiple light emitting elements, such as LEDs (light emitting diodes) or the like, which can be individually turned on or off, aligned in the direction parallel to the rotational axis of the photosensitive drum 1, and forma a latent image on the peripheral surface of the photosensitive drum 1 by exposing the photosensitive drum 1 with the use of the multiple light emitting elements. Also in this case, the exposure area E in which the peripheral surface of the photosensitive drum 1 is exposed may be the same in position as the one in the first embodiment.

Embodiment 2

In the first embodiment, the image forming apparatus A was structured so that after the installation of the development cartridge 30 into the cartridge drawer 40, the development cartridge 30 and photosensitive drum 1 are not separated from each other. However, the present invention is also applicable to an image forming apparatus structured so that even after the installation of the development cartridge 30, the photosensitive drum 1 and development roller 32 can be separated from each other when the usage of the development cartridge 30 is not required.

In the following description of this embodiment, therefore, an image forming apparatus equipped with a mechanism for placing the photosensitive drum 1 and development roller 32 in contact with each other, or separating them from each other, by moving one of them, is described regarding its structure.

Figure 11:
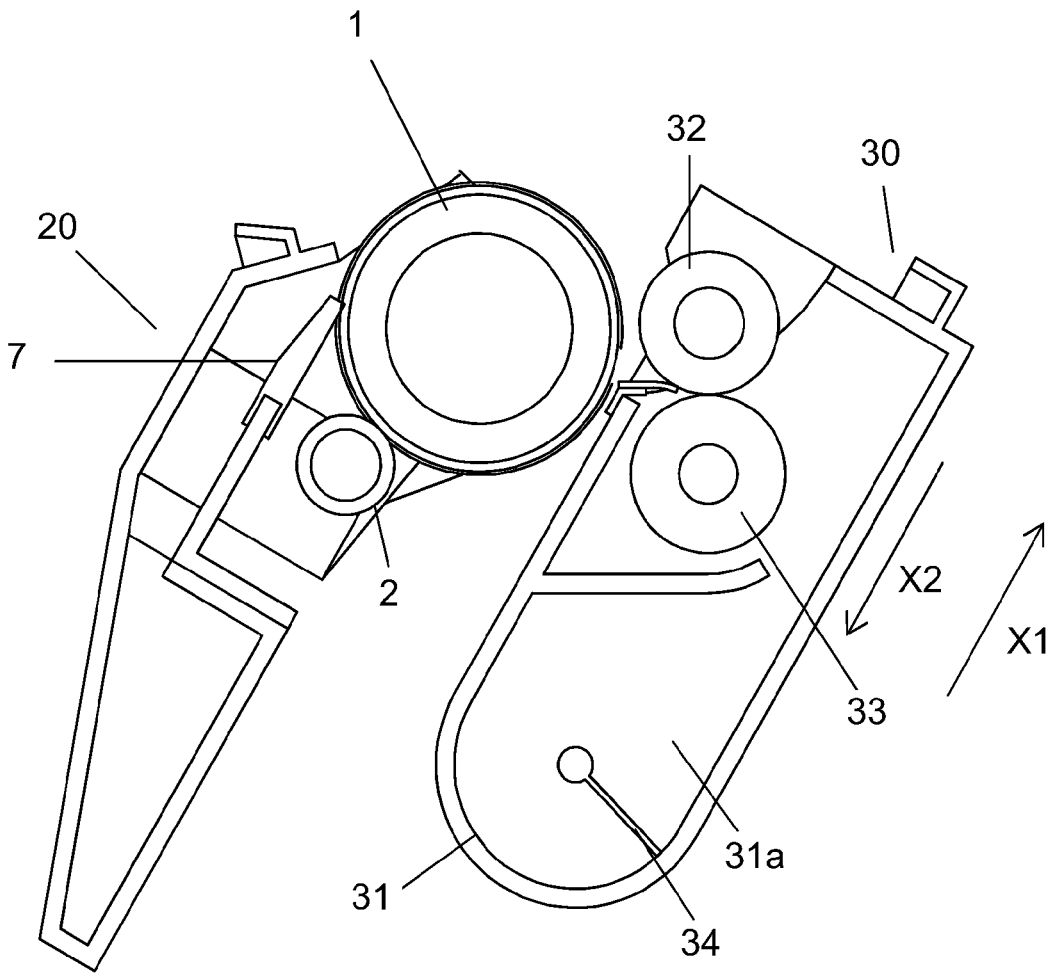
FIG. 11 is a sectional view of a combination of the photosensitive member unit and development cartridge when the combination is in the main assembly of the apparatus and the photosensitive member is not in contact with the development roller.

Hereafter, referring to FIGS. 9 and 11, which are sectional views of the combination of the photosensitive member unit 20 and development cartridge 30, the image forming apparatus having a mechanism for placing the photosensitive drum 1 and development roller 32 in contact with each other, or separating them from each other is described.

When the combination is in the state shown in FIG. 9, the development roller 32 is in the development position in which it is in contact with the photosensitive drum 1, and therefore, it can supply the peripheral surface of the photosensitive drum 1 with toner. This state of the image forming apparatus A is referred to as "development roller contact state". When it is unnecessary to supply the peripheral surface of the photosensitive drum 1 with toner, the development roller 32 is movable from the development position to its separation position, shown in FIG. 11, in which it remains separated from the photosensitive drum 1. The state of the image forming apparatus A, in which the development roller 32 is in the separation position is referred to as "development roller separation state". By the way, the development position may be such a position that when the development roller 32 is in the development position, there is no contact between the development roller 32 and photosensitive drum 1, as long as the distance between the development roller 32 and photosensitive drum 1 is small enough for the toner on the development roller 32 to be supplied to the peripheral surface of the photosensitive drum 1 by an electric field. Thus, the following description of this embodiment is applicable to an image forming apparatus structured so that its development roller 32 and photosensitive drum 1 do not contact each other when they are in the contact position.

The image forming apparatus A has an unshown mechanism which can place the development roller 32 in the development position or separation position. This mechanism is enabled to contact the development cartridge 30. As it receives a signal from an unshown controller, its actuator is driven to press the development cartridge 30 to move the development cartridge 30, whereby the development roller 32 is moved from the development position to the separation position or vice versa. In this embodiment, it is moves from the development position to the separation position by being pressed in the direction indicated by an arrow mark X1, or from the separation position to the development position by being pressed in the direction indicated by an arrow mark X2.

Normally, the development roller separating mechanism is controlled so that while the image forming apparatus A is in an image forming operation, the development roller separating mechanism keeps the development roller 32 in contact with the photosensitive drum 1, whereas at the end of an image forming operation, the development roller separating mechanism moves the development roller 32 back into the separation position. However, it becomes sometime necessary for a user to temporarily interrupt an ongoing image forming operation and uninstall the development cartridge 30 to remove a jammed sheet of recording medium or the like, or carry out a like operation. Conventionally, therefore, it was necessary for an image forming apparatus to be structured so that the development roller 32 can be moved from the development position to the separation position to uninstall and reinstall the development roller 32. Therefore, an image forming apparatus needs to be provided with such a mechanism, or to be so controllable, that as the door of the image forming apparatus A is opened to remove the development cartridge 30 from the image forming apparatus A, the development roller 32 is moved from the development position to the separation position. Thus, it sometimes occurred that in order to equip an image forming apparatus with such a mechanism, or to enable the apparatus to be controlled as described above, the image forming apparatus had to be increased in size, and/or the apparatus increased in cost.

However, if an image forming apparatus is structured like the one in this embodiment, the photosensitive member unit 20 is not intrusive into the path of the development cartridge 30. Therefore, it is possible to remove the development cartridge 30 without separating the development roller 32 from the photosensitive drum 1 with the use of the development roller separating mechanism. Therefore, it is unnecessary for an image forming apparatus to be provided with such a mechanism or control that makes it possible for the development roller 32 to be separated from the photosensitive drum 1. Thus, this embodiment can make it unnecessary for an image forming apparatus to be increased in cost and/or size to provide the apparatus with the above described mechanism and/or control.

Figure 13A:
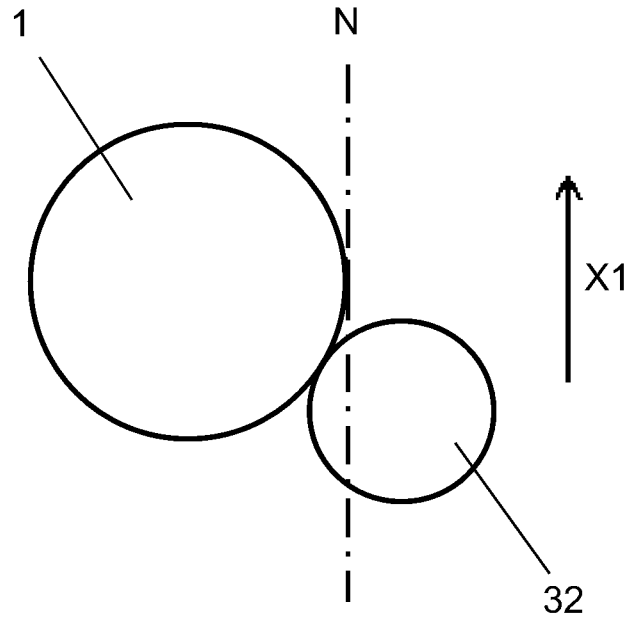
FIG. 13(*a*) and FIG. 13(*b*) are schematic drawings showing the positional relationship between the development roller and photosensitive drum in a conventional image forming apparatus.
Figure 13B:
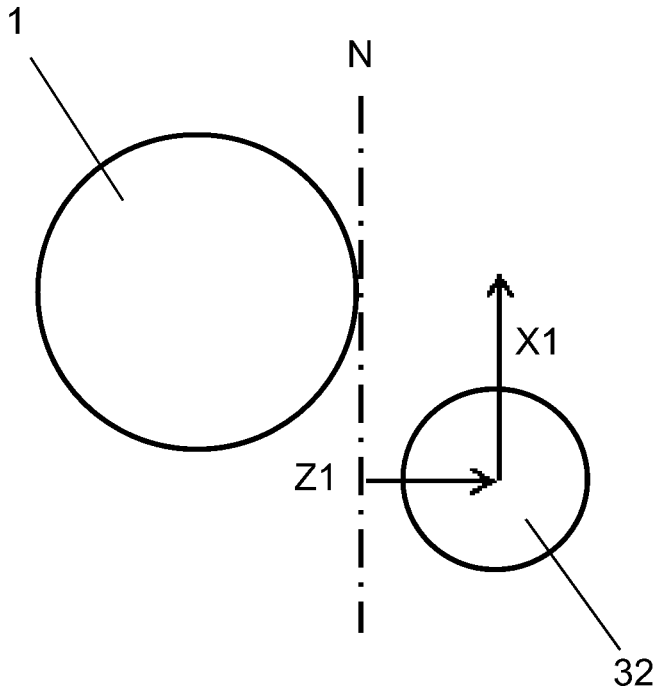

FIG. 13(*a*) and FIG. 13(*b*) are schematic drawings for showing the positional relationship between the development roller 32 and photosensitive drum 1 in a conventional image forming apparatus, as seen from the direction parallel to the axial line of the development roller 32, when the development roller 32 is in contact with the photosensitive drum 1, and when the development roller 32 is in its separation position, respectively. In the case of a conventional image forming apparatus, in order to remove the development roller 32, it was necessary to move the development roller 32 in the direction Z1, which is inter-sectional to the development cartridge uninstallation direction X1, and then, to move the development cartridge 30 in the cartridge uninstallation direction X1. That is, in order to make the development roller 32 separate from the photosensitive drum 1 by moving the development roller 32 in the direction of a line N which is tangential to the photosensitive drum 1 and parallel to the development cartridge uninstallation direction X1, the development roller 32 had to be moved in the direction Z1 before the development cartridge 30 is uninstalled.

Figure 12:
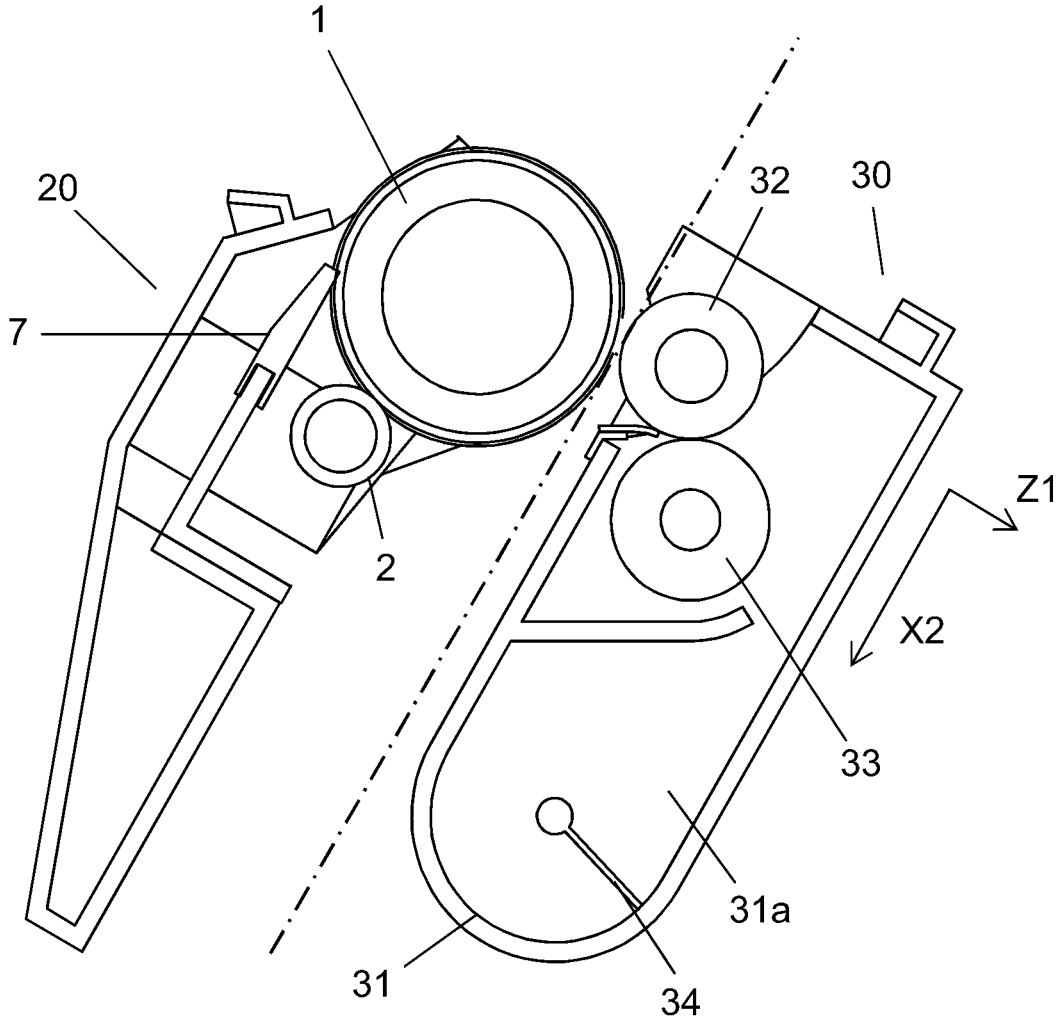
FIG. 12 is a sectional view of a combination of the photosensitive member unit and development cartridge when the combination is in the main assembly of the apparatus and the photosensitive member is not in contact with the development roller.
Figure 14A:
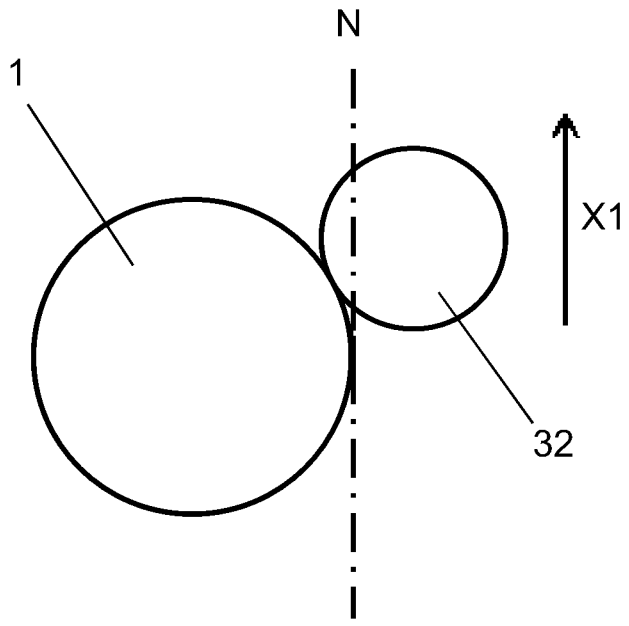
FIG. 14(*a*) and FIG. 14(*b*) are schematic drawings which show the positional relationships between the development roller and photosensitive drum 1 according to the present invention.
Figure 14B:
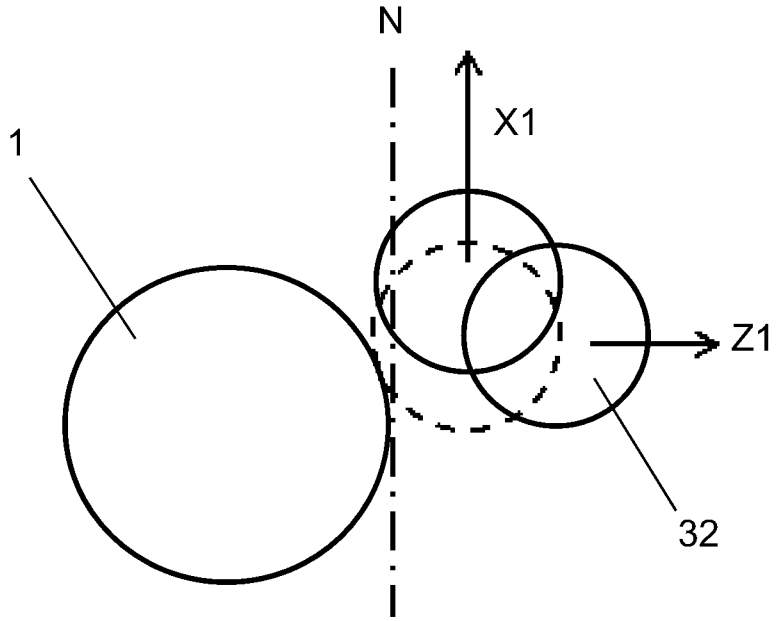

In comparison, FIG. 14(*a*) and FIG. 14(*b*) are schematic drawings which show the positional relationships between the development roller 32 and photosensitive drum 1, as seen from the direction parallel to the axial line of the development roller 32 when the development roller 32 is, and not, respectively, in contact with the photosensitive drum 1. As is evident from FIG. 14, in this embodiment, even when the development roller 32 is in contact with the photosensitive drum 1, the area of contact between the development roller 32 and photosensitive drum 1 is on the drum side of the line N which is tangential to the photosensitive drum 1 and parallel to the development cartridge uninstallation direction X1, it is possible to uninstall the development cartridge 30 simply by moving the development cartridge 30 in the developer cartridge uninstallation direction X2. By the way, the direction in which the development roller 32 is to be moved to be moved from the development position to the separation position may be the developer cartridge removal direction X1, direction Z1 which is perpendicular to the developer cartridge removal direction X1, or such a direction which has both a directional component which is parallel to the developer cartridge removal direction X1 and a directional component which is parallel to the direction Z1. The steps which are to be taken to move the development roller 32 from the development position to the separation position in the direction Z1 are shown in FIG. 12, which is a sectional view of the combination of the photosensitive member unit 20 and development cartridge 30 when the combination is in the image formation position in the main assembly of the image forming apparatus A. An image forming apparatus may be structured so that the development roller 32 is movable from the development position to the separation position by being moved in both the installation direction X2 and the direction parallel to the rotational axis of the development roller 32.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-247212 filed on Dec. 18, 2015, which is hereby incorporated by reference herein in its entirety.

What is claimed is:

1. An image forming apparatus for forming an image on an image formation medium, the image forming apparatus comprising:

a main assembly;

a cartridge receiving portion provided in the main assembly;

a rotatable photosensitive member provided in the main assembly;

a cartridge detachably mounted in the cartridge receiving portion, the cartridge including a rotatable developer carrying member configured to carry a developer to be supplied to the photosensitive member and a developer accommodating portion configured to accommodate the developer to be supplied to the developer carrying member; and a transfer belt disposed in contact with the photosensitive member, wherein the cartridge:

moves along a mounting direction when the cartridge is being mounted in the cartridge receiving portion;

is disposed in a downstream side of the transfer belt, with respect to the mounting direction, in a state where the cartridge is mounted in the cartridge receiving portion; and is detachable from the cartridge receiving portion while the photosensitive member remains in the main assembly, and wherein in a state where the cartridge is mounted in the cartridge receiving portion:

the developer accommodating portion is disposed downstream of a rotation axis of the rotatable developer carrying member with respect to the mounting direction; and a developing portion, where a surface of the developer carrying member is in contact with or closest to the photosensitive member, is disposed downstream of the rotation axis of the developer carrying member or at the same position as the rotation axis of the developer carrying member, with respect to the mounting direction.

2. The apparatus according to claim 1, wherein a transfer portion, where the transfer belt contacts the surface of the photosensitive member, is disposed upstream of the developing portion with respect to the mounting direction of the cartridge.

3. The apparatus according to claim 1, wherein the rotatable developer carrying member is movable between a spaced position where the rotatable developer carrying member is spaced from the photosensitive member and a developing position where the rotatable developer carrying member is in contact with the photosensitive member or closer to the photosensitive member than in the spacing position.

4. The apparatus according to claim 1, wherein the photosensitive member is mountable to and dismountable from the main assembly.

5. The apparatus according to claim 1, wherein:

the main assembly includes a movable member including the cartridge receiving portion and carrying the cartridge between a first position and a second position with the cartridge mounted in the cartridge receiving portion, when the movable member is in the first position, an image forming operation is performed, and when the movable member is in the second position, the cartridge is mountable to and dismountable from the cartridge receiving portion.

6. The apparatus according to claim 1, wherein the rotatable developer carrying member is movable between a spaced position where the rotatable developer carrying member is spaced from the photosensitive member and a developing position where the rotatable developer carrying member is in contact with the photosensitive member or closer to the photosensitive member than in the spacing position.

7. The apparatus according to claim 1, wherein the photosensitive member is mountable to and dismountable from the movable member.

8. An image forming apparatus for forming an image on an image formation medium, the image forming apparatus comprising:

a main assembly;

a cartridge receiving portion provided in the main assembly;

a rotatable photosensitive member provided in the main assembly;

a cartridge detachably mounted in the cartridge receiving portion, the cartridge including a rotatable developer carrying member configured to carry a developer to be supplied to the photosensitive member; and a transfer belt disposed in contact with the photosensitive member, wherein the cartridge:

moves along a mounting direction when the cartridge is being mounted in the cartridge receiving portion; and is detachable from the cartridge receiving portion while the photosensitive member remains in the main assembly, and wherein in a state where the cartridge is mounted in the cartridge receiving portion:

a transfer portion, where the transfer belt contacts a surface of the photosensitive member, is disposed upstream of a developing portion, where a surface of the developer carrying member is in contact with or closest to the photosensitive member, with respect to the mounting direction; and a rotation axis of the rotatable developer carrying member is disposed upstream of or at the same position as a rotation axis of said photosensitive member, with respect to the mounting direction.

9. The apparatus according to claim 8, wherein the rotatable developer carrying member is movable between a spaced position where the rotatable developer carrying member is spaced from the photosensitive member and a developing position where the rotatable developer carrying member is in contact with the photosensitive member or closer to the photosensitive member than in the spacing position.

10. The apparatus according to claim 8, wherein the photosensitive member is mountable to and dismountable from the main assembly.

11. The apparatus according to claim 8, wherein:

the main assembly includes a movable member including the cartridge receiving portion and carrying the cartridge between a first position and a second position with the cartridge mounted in the cartridge receiving portion, when the movable member is in the first position, an image forming operation is performed, and when the movable member is in the second position, the cartridge is mountable to and dismountable from the cartridge receiving portion.

12. An image forming apparatus for forming an image on an image formation medium, the image forming apparatus comprising:

a main assembly;

a rotatable photosensitive member;

a cartridge detachably mounted in a cartridge receiving portion, the cartridge including a rotatable developer carrying member configured to carry a developer to be supplied to the photosensitive member and a developer accommodating portion configured to accommodate the developer to be supplied to the developer carrying member; and a movable member including the cartridge receiving portion and carrying the cartridge and the rotatable photosensitive member between an inside position inside the main assembly and an outside position outside the main assembly with the cartridge mounted in the cartridge receiving portion, wherein when the movable member is in the outside position, the cartridge is mountable to and dismountable from the cartridge receiving portion, wherein the cartridge:

moves along a mounting direction when the cartridge is being mounted in the cartridge receiving portion;

is detachable from the cartridge receiving portion while the photosensitive member remains in the movable member, and wherein in a state where the cartridge is mounted in the cartridge receiving portion:

the developer accommodating portion is disposed downstream of a rotation axis of the rotatable developer carrying member with respect to the mounting direction; and a developing portion, where a surface of the developer carrying member is in contact with or closest to the photosensitive member, is disposed downstream of the rotation axis of the developer carrying member or at the same position as the rotation axis of the developer carrying member, with respect to the mounting direction.

13. The apparatus according to claim 12, further comprising:

a transfer belt disposed in contact with the photosensitive member, wherein in a state where the cartridge is mounted in the cartridge receiving portion and the movable member is in the inside position, the cartridge is disposed in a downstream side of the transfer belt, with respect to the mounting direction.

14. The apparatus according to claim 13, wherein a transfer portion, where the transfer belt contacts the surface of the photosensitive member, is disposed upstream of the developing portion with respect to the mounting direction of the cartridge.

15. An image forming apparatus for forming an image on an image formation medium, the image forming apparatus comprising:

a main assembly;

a rotatable photosensitive member;

a cartridge detachably mounted in a cartridge receiving portion, the cartridge including a rotatable developer carrying member configured to carry a developer to be supplied to the photosensitive member and a developer accommodating portion configured to accommodate the developer to be supplied to the developer carrying member;

a movable member including the cartridge receiving portion and carrying the cartridge and the rotatable photosensitive member between an inside position inside the main assembly and an outside position outside the main assembly with the cartridge mounted in the cartridge receiving portion; and a transfer belt disposed in contact with the photosensitive member, wherein when the movable member is in the outside position, the cartridge is mountable to and dismountable from the cartridge receiving portion, wherein the cartridge:

moves along a mounting direction when the cartridge is being mounted in the cartridge receiving portion; and is detachable from the cartridge receiving portion while the photosensitive member remains in the movable member, and wherein in a state where the cartridge is mounted in the cartridge receiving portion:

a transfer portion, where the transfer belt contacts a surface of the photosensitive member, is disposed upstream of a developing portion, where a surface of the developer carrying member is in contact with or closest to the photosensitive member, with respect to the mounting direction; and a rotation axis of the rotatable developer carrying member is disposed upstream of or at the same position as a rotation axis of said photosensitive member, with respect to the mounting direction.

16. The apparatus according to claim 15, further comprising:

a transfer belt disposed in contact with the photosensitive member, wherein in a state where the cartridge is mounted in the cartridge receiving portion and the movable member is in the inside position, a transfer portion, where the transfer belt contacts a surface of the photosensitive member, is disposed upstream of a developing portion, where a surface of the developer carrying member is in contact with or closest to the photosensitive member, with respect to the mounting direction.

17. The apparatus according to claim 15, wherein the rotatable developer carrying member is movable between a spaced position where the rotatable developer carrying member is spaced from the photosensitive member and a developing position where the rotatable developer carrying member is in contact with the photosensitive member or closer to the photosensitive member than in the spacing position.

18. The apparatus according to claim 15, wherein the photosensitive member is mountable to and dismountable from the movable member.

* * * * *